US006072168A

United States Patent [19]

Feher et al.

[11] Patent Number: 6,072,168

[45] Date of Patent: Jun. 6, 2000

[54] MICROWAVE RESONATOR FOR THE HIGH TEMPERATURE TREATMENT OF MATERIALS

[75] Inventors: Lambert Feher, Linkenheim-Hochstetten; Guido Link, Karlsruhe, both of Germany

[73] Assignee: Forschungszentrum Karlsruhe GmbH, Karlsruhe, Germany

[21] Appl. No.: 09/241,641

[22] Filed: Feb. 1, 1999

Related U.S. Application Data

[63] Continuation-in-part of application No. PCT/EP97/03328, Jun. 25, 1997.

[30] Foreign Application Priority Data

Aug. 17, 1996 [DE] Germany ..... 196 33 245

[51] Int. Cl.[7] ..... H05B 6/70

[52] U.S. Cl. ..... 219/695; 219/696

[58] Field of Search ..... 719/695, 696, 719/697, 700, 701, 746, 748, 750, 762

[56] References Cited

U.S. PATENT DOCUMENTS

| | | | |
|---|---|---|---|
| 3,980,855 | 9/1976 | Boudouris et al. | 219/696 |
| 4,221,948 | 9/1980 | Jean | 219/697 |
| 4,589,423 | 5/1986 | Turner | 607/154 |
| 5,481,092 | 1/1996 | Westmeyer | 219/679 |
| 5,532,462 | 7/1996 | Butwell et al. | 219/695 |
| 5,632,921 | 5/1997 | Risman et al. | 219/750 |
| 5,834,744 | 11/1998 | Risman | 219/697 |

FOREIGN PATENT DOCUMENTS

| | | |
|---|---|---|
| 521896 | 10/1975 | Australia . |
| 2 072 618 | 9/1971 | France . |
| 2 265 042 | 10/1975 | France . |

*Primary Examiner*—Teresa Walberg
*Assistant Examiner*—Jeffrey Pwu
*Attorney, Agent, or Firm*—Klaus J. Bach

[57] ABSTRACT

In a high-mode microwave resonator for high-temperature treatment of materials, the resonator comprises a housing with a polygonal cross-section formed by planar housing wall segments and planar end walls. One of the end walls includes an in-coupling window arranged so as to direct a microwave beam into the resonator at an angle with respect to the housing axis and toward an edge between adjacent wall segments such that the microwave beam is divided, upon reflection, into two symmetrical beam components which, upon further reflection, provide for an essentially homogeneous field distribution throughout the resonator interior.

5 Claims, 4 Drawing Sheets

Fig. 2b
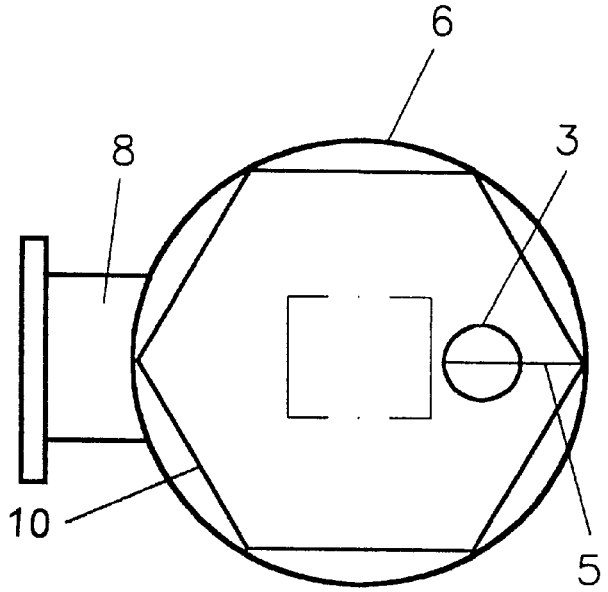
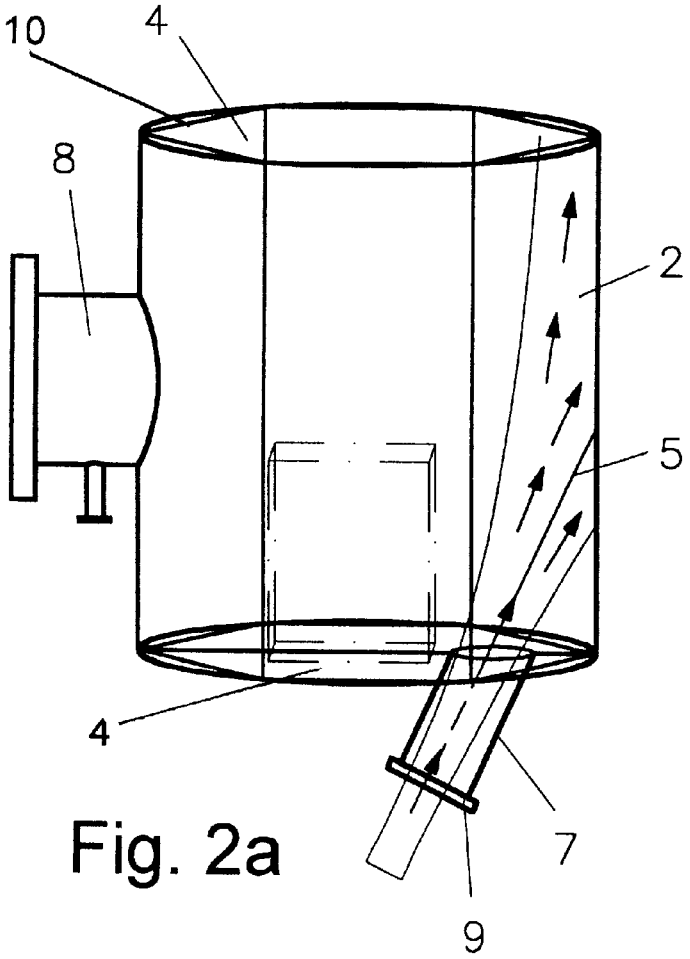
Fig. 2a

MICROWAVE RESONATOR FOR THE HIGH TEMPERATURE TREATMENT OF MATERIALS

This is a Continuation-in-Part application of international patent application PCT/EP97/03328 filed Jun. 25, 1997 and claiming the priority of German application No. 196 33 245.1 filed Aug. 17, 1996.

BACKGROUND OF THE INVENTION

The invention relates to a microwave resonator for the high temperature treatment of materials. It is intended to permit the sintering or the drying of materials. Such tasks can be optimized with a uniform field distribution within the interior of the microwave resonator.

DE 43 13 806 discloses an apparatus for heating materials by microwaves. The apparatus consists of a heating chamber through which the material to be processed is transported. The heating chamber has a wall portion, which has a concave curvature. The microwave beam coupled into the apparatus is reflected at this wall portion and focussed onto the material volume to be heated.

A similar apparatus is disclosed in WO 90/03714. In this case, the heating chamber is intended to receive food to be heated with a uniform temperature field.

JP 4-137391 discloses a heating chamber with a second reflective wall disposed opposite the first reflective wall. In this way, the process volume is to be filled with a strengthened uniform field to provide for uniform heating of an object in the heating chamber.

U.S. Pat. No. 5,532,462 discloses a cylindrical reaction container whose interior is heated by microwave energy. To this end, a multi-mode microwave is coupled into the container such that it is absorbed at the interior wall and reflected in such a way that the absorption and reflection occurs in a helically progressing fashion. The container interior is said to be uniformly heated in this way.

During the sintering of ceramic parts, inhomogenous field distributions lead to different densities within a single charge and to inhomogeneous densifications within single samples. This, in the end effect, results in mechanical stresses, which may deform shaped parts or which may even shatter them. This problem and the understanding derived therefrom that a uniform volume heating is very important during sintering procedures, that is generally during material processing, are treated in the publication, "MICROWAVE SINTERING OF ZIRCOMA-TOUGHENED ALUMINUMA COMPOSITES" by H. D. Kimreg et al., (Mat. Res. Soc. Symp. Proc. Vol. 189, 1991, Material Research Society, pages 243 to 255). Two high-mode, cylindrical microwave ovens are described, one operated at 2.45 GHz and the other at 28 GHz. The sintering process was successful only at the high frequency.

At the MRS Spring Meeting in San Francisco, Apr. 11, 1996(Symp. Microwave Processing of MaterialsV) L. Feher et al. reported under the title "the MiRa/Thesis 3D-Code Package for Resonator Design and Modeling of Millimeter-Wave Material Processing", about the simulation of the field distribution in a design of a high-mode cylindrical resonator with a spherical cover used by IAP in Nizhny Novgorod.

It is shown therein that resonators with a circular cylindrical or spherical geometry have a field distribution, which generally needs improvement. Because of the topology field focus areas necessarily occur in the interior of the resonator so that only a relatively small operating volume with homogeneous field distribution is available within the resonator volume. Additional technical measures such as mode stirrers and diffuse surfaces, which distribute the microwaves, improve the situation, but they are relatively complicated and expensive for industrial application.

It is the object of the present invention to provide a resonator in which highly inhomogeneous caustic field peaks do not occur. A microwave beam coupled into the resonator should be distributed within the resonator interior so that goods to be heated or to be sintered in the resonator (or microwave oven) are subjected to an essentially homogeneous field.

SUMMARY OF THE INVENTION

In a high-mode microwave resonator for high-temperature treatment of materials, the resonator comprises a housing with a polygonal cross-section formed by planar housing wall segments and planar end walls. One of the end walls includes an in-coupling window arranged so as to direct the microwave beam into the resonator at an angle with respect to the housing axis and toward an edge between adjacent wall segments such that the microwave beam is divided, upon reflection, into two symmetrical beam components which, upon further reflection, provide for an essentially homogeneous field distribution throughout the resonator interior.

All the surface segments of the resonator are planar or topologically flat. In this way, the microwave beam coupled into the resonator remains divergent upon being reflected at the walls and is not focussed as it may happen with circular cylindrical or spherical resonator walls. With the first reflection, the beam is divided into two symmetrical halves since the beam axis is directed from the microwave in-coupling window first toward the adjacent common edge between two surface segments. In this way, the beam is widened after the first reflection, which could not be achieved if the beam would be directed only toward a single surface segment.

It would seem to be reasonable to assume that the beam is further widened if the beam coupled into the resonator is continuously reflected in this manner. Consequently, undesirable excessive field strength peaks cannot occur as they do with a pure cylindrical geometry by focussing effects. As a result, a resonator with a polygonal cross-section of a relatively low order should provide a usable volume (work or process volume), which is substantially larger than that of cylindrical resonators.

Field calculations using a computer program especially developed for that purpose confirm that reasoning. This computer program, called the MiRa-Code (Microwave Ray tracer) selected polygonal housings as the most suitable. The MiRa Code is used to calculate stationary wave fields. The calculated results have been found to be in good agreement with test results obtained from actually built resonators.

The MiRa code was developed as a grid-free analytical computing tool with which couplex resonator geometries can be examined. A beam formalism, which represents all the properties for electromagnetic fields in a stationary state, provides the theoretical basis for this code. This permits the description of a monochromatic, harmonically changing wave field with the vector potential $$A(x, t)=A(x)e^{-iwt}$$

With the inclusion of calibration transformations, the condition:

$$\Phi(x,t)=0$$

is to be maintained (see again MRS Spring Meeting 1996, particularly "Optical field calculations with the MiRa Code" referred to earlier).

It has been found that a hexagonal or octagonal resonator cross-section provides for a homogeneous field distribution with the lowest variations, that is, for the best result whereby essentially the whole resonator volume can be used as work or process volume. Other even numbered polygonal resonator cross-sections do not have the same quality as far as field homogeneity is concerned. Nevertheless, even an octagonal resonator cross-section is substantially more suitable for providing a homogeneous field than the geometries referred to in the state of the art, even if the prior art arrangements include a mode mixer within the resonator.

The interior walls of the resonator are metallic or they are covered by a metallic layer so that they form mirrors for the microwaves. They reflect better the higher the electric conductivity of the walls is. They further need to be process environment resistant, that is, they must be chemically inert with regard to the atmosphere in contact therewith. They further need to be cooled in order to be able to withstand the thermal load resulting mainly from radiation and, to some minor degree, also from convection. Depending on the application, a material such as silver or copper or gold or stainless steel or another suitable metal may be used as the metallic material forming the wall or the inner wall cover of the resonator.

The in-coupling of the microwave into the resonator occurs from one of the planar axial end faces. The coupling opening is disposed outside the center of the end face so that there is a common edge of two adjacent side wall segments which is close to the coupling opening. The beam axis extends from the coupling opening to this common edge and is divided there, with the first reflection, first into two beams with axes which extend mirror-like up to their second reflections.

With the homogeneous field distribution in the stationary state, the resonator is well suited as a microwave oven for the sintering of ceramic substances. But other objects may be heated dried or warmed up just as well.

The beam coupled to the resonator may be a quasi-optical beam with gauss-like beam profile or a similar microwave beam.

The advantages of the prismatic resonator with an even numbered symmetrical polygonal cross-section and a beam coupled into the resonator along a beam axis inclined with respect to the resonator axis and a beam division after the first reflection has been found to be optimal and advantageous. The theoretical values determined by the MiRa code were confirmed experimentally. It was found that the known technical beam distribution means such as mode mixers and diffusor plates are not needed. They provide for no further improvement. As a result, parts which have to be heated or sintered, that is so called green pellets, can be uniformly processed in industrial applications.

The invention will be described in greater detail on the basis of an embodiment representing an oven for the sintering of ceramic bodies.

BRIEF DESCRIPTION OF THE DRAWINGS

FIGS. 2*a* and 2*b* are views corresponding to those of FIGS. 1*a* and 1*b* showing a circular resonator with a hexagonal insert.

DESCRIPTION OF PREFERRED EMBODIMENTS

Figure 1A:
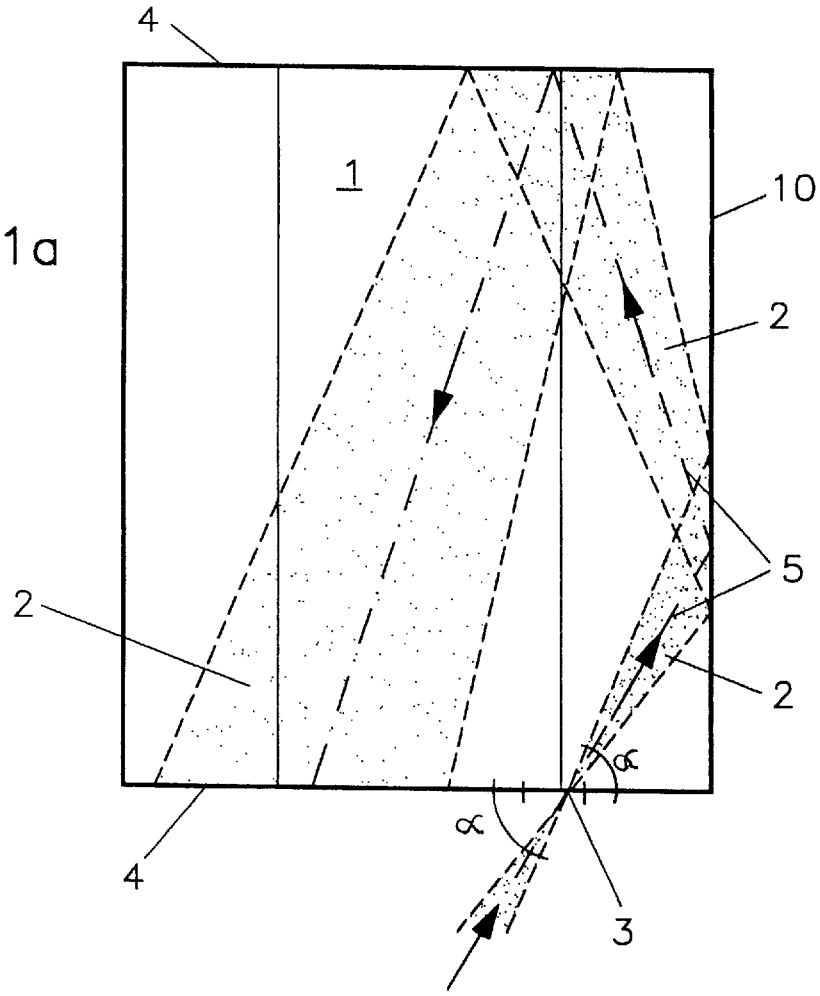
FIG. 1*a* shows schematically a hexagonal resonator cavity in a view normal to the resonator axis with a microwave beam coupled into the resonator cavity.
Figure 1B:
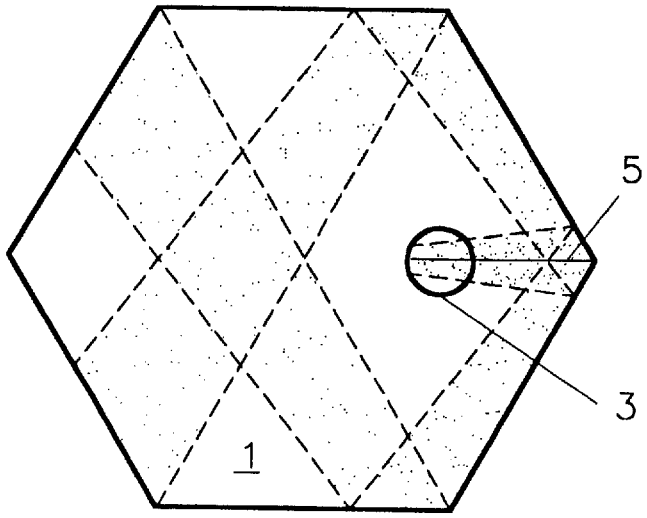
FIG. 1*b* shows the arrangement of FIG. 1*a* in an axial view.

As shown in FIGS. 1*a* and 1*b*, the quasi-optical microwave beam 2 is coupled into the resonator 1 with hexagonal cross-section and is reflected therein by the walls of the resonator (two reflections being shown). The microwave beam 2 enters the resonator 1 through the coupling opening 3 in the lower end face 4 of the resonator 1. The beam axis 5 of the beam extends at an angle $\alpha$ to the end face 4 including the coupling opening 3. The beam axis is oriented toward the closest edge between two adjacent planar surface sections of the polygonal resonator 1. On these two surface sections, the beam 2 is reflected for the first time and is divided into two symmetrical beams. With the divergent beam pattern and the large number of reflections, the whole interior of the resonator is uniformly exposed to the microwave radiation.

FIGS. 1*a* and 1*b* show this process only for the first two reflections to indicate how the field expansion occurs in the resonator space and consequently in the microwave oven. (In reality, the stationary field expansion in the resonator is present instantly after coupling of the beam.) Strong local field strength peaks (caustics) do not occur. As a result, hot spots of the ceramic bodies heated in the resonator 1 are avoided. The ceramic bodies to be processed are exposed to the microwave field in the whole operating volume (process volume) of the oven.

FIGS. 2*a* and 2*b* show a cylindrical structure 6 for the microwave oven including two connecting pieces 7 and 8 of which one (8) is mounted to the outer shell surface serving as access for temperature measurements, for evacuating the resonator interior or for flooding it with particular gases. The second connecting piece 7 is mounted to one of the two end faces 4 so as to be inclined with respect to the axis of the resonator. It serves to couple the microwave beam into the resonator interior. This resonator 1 is closed at the jointure with the connecting piece 7 by a coupling window 9.

In the cylindrical structure 6, there is disposed a hexagonal applicator insert 10, which extends over the full length between the two end faces 4 of the resonator. In FIGS. 2*a* and 2*b*, the applicator insert 10 is shown in a rotational position such that the beam axis 5 of the microwave beam entering the resonator intersects the closest edge of the two adjacent wall sections of the hexagonal applicator insert 10. In this way, the microwave beam 2 coupled into the resonator is symmetrically divided.

Figure 4:
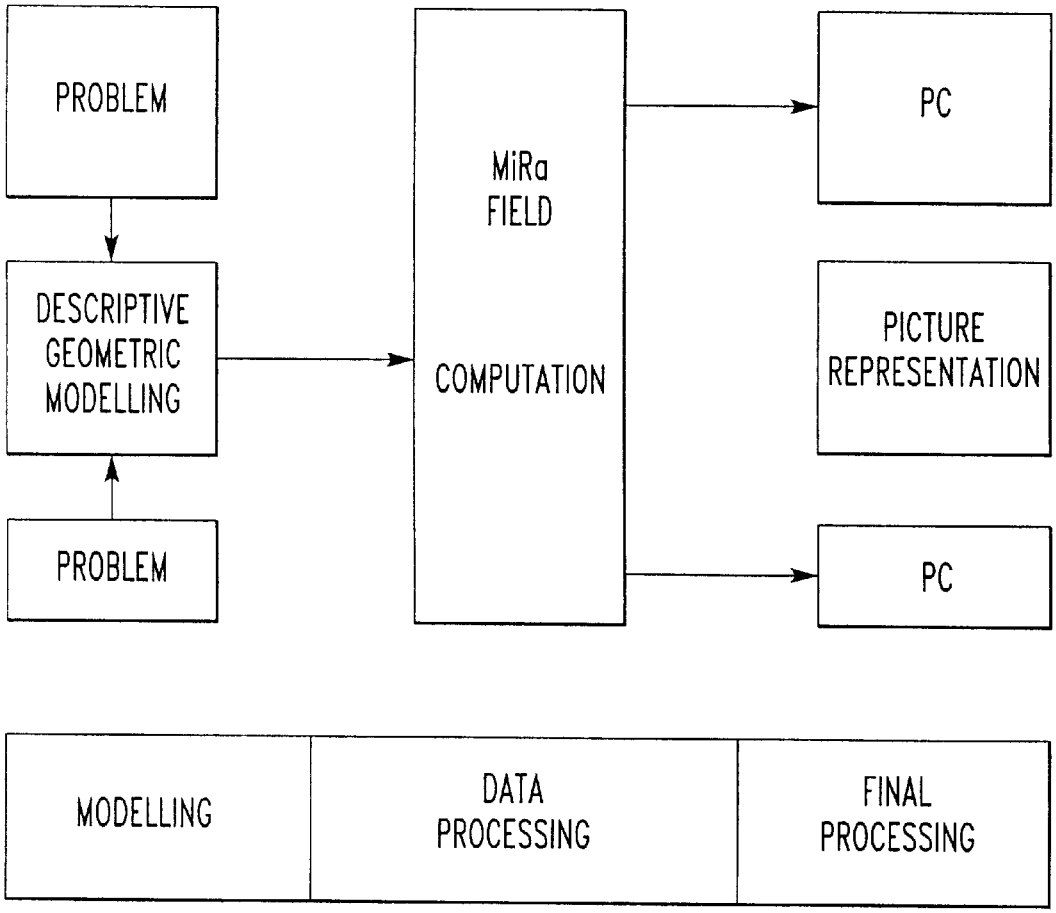
FIG. 4 is a block diagram showing the field calculation procedure using the MiRa code.

The MiRa Code is an important tool for determining and designing the optimal resonator geometry. Main features and its use is explained in FIG. 4. The detailed features and its operation are clearly presented in the literature mentioned earlier by the authors H. Fehers et al. Essentially, first a resonator model with polygonal cross-section is taken for the calculation of the field distribution occurring with this resonator geometry. A numeric calculation is then performed with the MiRa field computation, wherein the microwave beam 2 entering the resonator 1 is followed. The field expansion in the resonator 1 is successively established and represented graphically so that the longitudinal and transverse cross-sectional establishment of the field in the resonator interior can be presented for example by video.

For the oven design, it should be considered that the energy density in the defined operating volume of the oven is as large as possible with relatively little deviations of the field strength values from the average field strength (homogeneous distribution). For comparison of the conditions, the coherent volume is defined as the operating volume which, with the cylindrical original geometry, provides for the best field quality. By the study using the MiRa-code for examining the field uniformity of various prismatic applicator structure designs, it was found that the hexagonal structure with applications of the beam to one of the corners as shown in FIGS. 1*a* and 1*b* was optimal.

Figure 3:
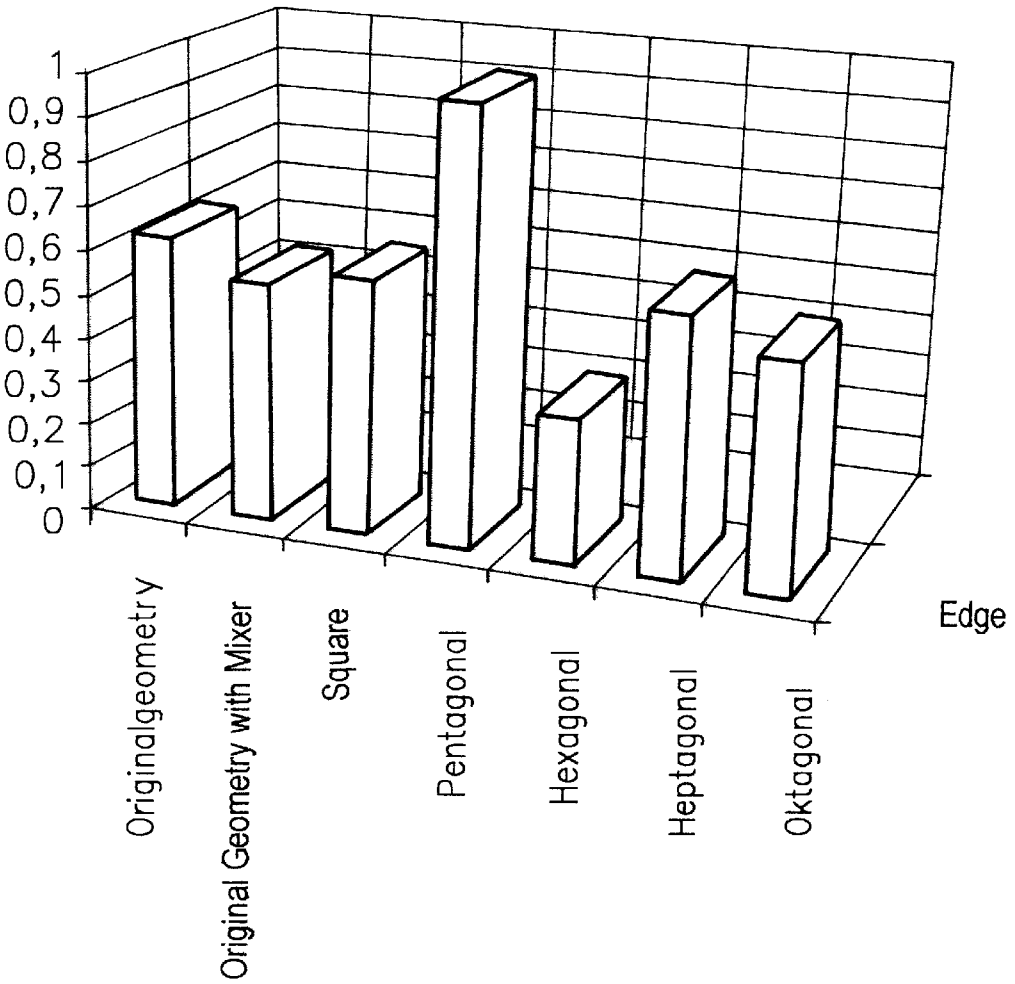
FIG. 3 shows the dependency of the field homogeneity and the energy density in a resonator cavity depending on the order of the polygonal cross-section and the type of the beam applications.

In this case, the ratio (Distribution of the energy density in the operating volume): (average energy density available in the operating volume) was the lowest. FIG. 3 shows the quotients for the edge or wall application of the beam normalized on the basis of the maximum (most disadvantageous) case. With the exception of the pentagonal cross-section, the application of the beam to the edges provides for better homogeneous energy distribution. FIG. 3 shows the normalized field distribution as predicted by the MiRa-Code. It can be seen that the hexagonal applicator provides for the most uniform field distribution with the highest energy density. This finding was confirmed experimentally with thermal papers placed in the resonator. They showed a fully homogeneous blackening for all the planes up to the applicator walls. Consequently, the calculated predictions have been confirmed experimentally. The MiRa-Code was therefore found to be highly reliable. Computations for polygonal cross-sections of higher order show that the field distribution rapidly approaches that of a cylindrical resonator.

The first column shows the ratio of the average energy and the distribution of the original (cylindrical) geometry with the mode mixer not in use. The second column shows the gain obtained by operating the mixer, which rotates at such a speed, that there are no fluctuations noticeable from the various momentary positions of the mixer. The distribution and available energy density of the original configuration can be considered comparable to a cubic (square resonator cross-section) applicator geometry; but in this case, the homogeneity is obtained without auxiliary means such as a mode mixer or scattering disc.

The study of the field distribution obtained with the MiRa Code was checked by experimental examination using polygons starting with a square cross-section, fitted into the cylindrical shape of the original resonator. As a result, the volume of the resonator space increases with an increasing number of corners. Consequently, with a constant energy coupled into the resonator, the available energy density is smaller. This is particularly apparent for the pentagon column.

For even numbered polygonal cross-sections, there is a noticeable decrease in the field distribution ratio from the original geometry without operating mode mixer to the square cross-section and down to the hexagonal cross-section. Then the ratio increases again, but is always better for even numbered polygons then for beam application to the wall. The normalized field distribution ratio is substantially increased for uneven numbered polygons. The normalized distribution ratio for polygons of a higher order rapidly approaches that of the original cylindrical geometry without mode mixer.

What is claimed is:

1. A microwave resonator for high-temperature treatment of materials, comprising: a resonator housing having a longitudinal axis and a symmetrical interior shape of a prism with an even-numbered polygonal cross-section, said resonator housing comprising planar side wall segments having side edges and end edges and being joined along their side edges and planar end walls joined to said side wall segments at the end edges thereof, one of said end walls having a microwave in-coupling window disposed near one of said side edges and forming a beam path with an axis which is inclined with respect to the longitudinal housing axis at an acute angle and which is directed toward said one side edge between the two planar side wall segments forming said edge closest to the in-coupling window such that a divergent microwave beam entering said resonator along said beam path axis is divided, upon its first reflection, into two symmetrical beam components directed toward the other end wall and being reflected in a further fanning fashion by said other end wall, thereby providing, with all the successive reflections, for an essentially homogenous field distribution throughout the whole resonator volume.

2. A microwave resonator according to claim 1, wherein said resonator has a hexagonal or octagonal cross-section for achieving a homogenous field distribution with minimal variations.

3. A microwave resonator according to claim 2, wherein said resonator has inner walls coated with a metallic material of high electric conductivity selected from the group consisting of silver, gold, copper, aluminum, and stainless steel on the basis of suitability for a particular process, said coating forming a mirror for the microwaves coupled into said resonator.

4. A microwave resonator according to claim 3, wherein said resonator is an oven for the high-temperature treatment of materials such as heating, drying, or sintering or welding of ceramics or the heat treatment of semiconductors.

5. A microwave resonator according to claim 4, wherein said microwave beam coupled into said resonator is a quasi-optical beam with a gauss-type beam profile or a closely similar profile.

* * * * *